US009339777B2

(12) United States Patent
Vesala

(10) Patent No.: US 9,339,777 B2
(45) Date of Patent: May 17, 2016

(54) METHOD, AN APPARATUS AND A ROTOR FOR HOMOGENIZING A MEDIUM

(71) Applicant: Sulzer Management AG, Winterthur (CH)

(72) Inventor: Reijo Vesala, Kotka (FI)

(73) Assignee: Sulzer Management AG, Winterthur (CH)

( * ) Notice: Subject to any disclaimer, the term of this patent is extended or adjusted under 35 U.S.C. 154(b) by 0 days.

(21) Appl. No.: 14/681,048

(22) Filed: Apr. 7, 2015

(65) Prior Publication Data

US 2015/0314252 A1 Nov. 5, 2015

Related U.S. Application Data

(62) Division of application No. 11/578,444, filed as application No. PCT/CH2005/000151 on Mar. 14, 2005, now abandoned.

(30) Foreign Application Priority Data

Apr. 13, 2004 (EP) ..... 04405223

(51) Int. Cl.
*B01F 7/00* (2006.01)
*B01F 3/12* (2006.01)
*B01F 5/04* (2006.01)

(52) U.S. Cl.
CPC ..... *B01F 7/0025* (2013.01); *B01F 3/1221* (2013.01); *B01F 5/0473* (2013.01); *B01F 7/00175* (2013.01); *B01F 7/00908* (2013.01); *B01F 2215/0078* (2013.01); *B01F 2215/0422* (2013.01); *B01F 2215/0427* (2013.01)

(58) Field of Classification Search
CPC ..... B01F 7/00175
USPC ..... 366/99, 165.3, 262, 265, 325.7, 325.8, 366/327.4
See application file for complete search history.

(56) References Cited

U.S. PATENT DOCUMENTS 443,654 A 12/1890 Powers
525,865 A 9/1894 Rouse et al.
946,281 A * 1/1910 Smith ..... F04D 25/088 366/265
1,683,500 A 9/1928 Thordarson (Continued)

FOREIGN PATENT DOCUMENTS

JP 2002-153744 5/2002
WO 94/29514 A1 12/1994

OTHER PUBLICATIONS

International Search Report mailed Jul. 29, 2005 in Int'l Patent Application No. PCT/CH2005/000151, 3 pages.

(Continued)

*Primary Examiner* — David Sorkin
(74) *Attorney, Agent, or Firm* — Kilpatrick Townsend & Stockton LLP

(57) ABSTRACT

The present invention relates to a method, an apparatus and a rotor for homogenizing a medium. The invention may be utilized in all areas of industry where mere homogenization of a medium or mixing of at least two flowing media is needed. A preferred application of the invention can be found in pulp and paper making industry where various chemicals have to be mixed with fiber suspensions. A characterizing feature of the invention is the symmetry of the homogenizing operation in the homogenizing chamber.

13 Claims, 4 Drawing Sheets

(56) References Cited

U.S. PATENT DOCUMENTS

| | | | | |
|---|---|---|---|---|
| 1,774,910 | A | 9/1930 | Whatmough | |
| 1,815,308 | A * | 7/1931 | Liebeck | D21D 1/32 241/21 |
| 2,222,230 | A | 11/1940 | Knox | |
| 2,389,545 | A * | 11/1945 | Pointon | A21C 1/1405 366/291 |
| 4,199,266 | A | 4/1980 | Giusti | |
| 4,844,355 | A | 7/1989 | Kemp et al. | |
| 5,575,559 | A | 11/1996 | Roll | |
| 6,902,314 | B2 * | 6/2005 | Meinander | B01F 7/085 366/300 |
| 2004/0013032 | A1 | 1/2004 | Cappellino | |

OTHER PUBLICATIONS

Non-Final Office Action mailed Feb. 7, 2011 in U.S. Appl. No. 11/578,444, 8 pages.
Final Office Action mailed Sep. 29, 2011 in U.S. Appl. No. 11/578,444, 7 pages.
Non-Final Office Action mailed Feb. 7, 2013 in U.S. Appl. No. 11/578,444, 10 pages.
Final Office Action mailed Aug. 26, 2013 in U.S. Appl. No. 11/578,444, 8 pages.
Non-Final Office Action mailed Apr. 23, 2014 in U.S. Appl. No. 11/578,444, 9 pages.
Final Office Action mailed Jan. 7, 2015 in U.S. Appl. No. 11/578,444, 9 pages.

* cited by examiner

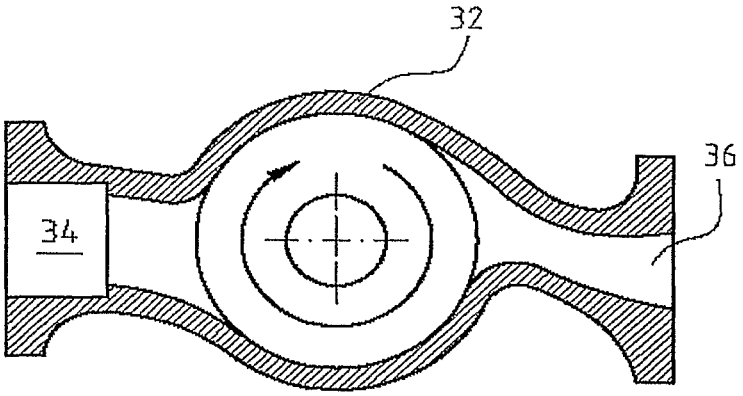
Fig. 4 (A-A)
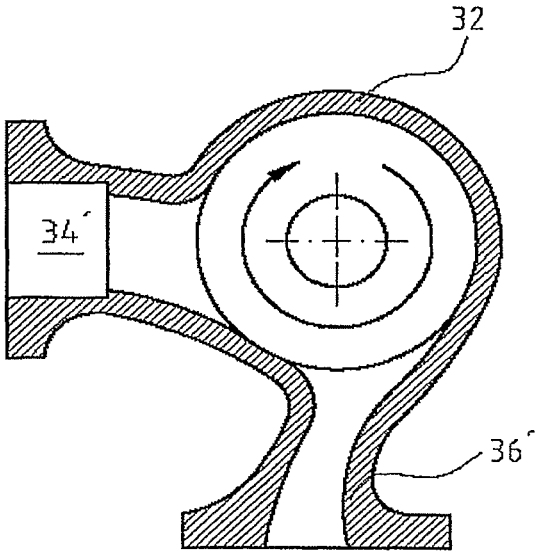
Fig. 5

METHOD, AN APPARATUS AND A ROTOR FOR HOMOGENIZING A MEDIUM

CROSS-REFERENCES TO RELATED APPLICATIONS

This application is a divisional of U.S. application Ser. No. 11/578,444, filed Oct. 13, 2007, which is a National Stage of International Application No. PCT/CH2005/000151, filed Mar. 14, 2005, and which claims the benefit of European Patent Application No. 04405223.1, filed Apr. 13, 2004, the disclosures of which are incorporated herein by reference.

FIELD OF THE INVENTION

The present invention relates to a method, an apparatus and a rotor for homogenizing a medium. The invention may be utilized in all areas of industry where mere homogenization of a medium or mixing of at least two flowing media are needed. A preferred application of the invention can be found in the pulp- and paper-making industry where various chemicals have to be mixed with fiber suspensions.

BACKGROUND OF THE INVENTION

In the following, prior art mixing apparatus of the pulp and paper industry have been discussed as examples of known techniques of mixing a flowing medium to another. However, it should be understood that in spite of the fact that only mixers of the pulp and paper industry have been discussed, it has not been done for the purpose of limiting the scope of the present invention to these fields of industry.

A widely used example of chemical mixers for pulp has been discussed in U.S. Pat. No. 5,279,709, which discloses a method of treating a fiber suspension having a consistency of 5-25% in an apparatus within a fiber suspension transfer line. The apparatus comprises a chamber having an axis in the direction of flow of the fiber suspension, a suspension inlet and a suspension outlet having an axis in alignment with the chamber axis, and a fluidizing rotor having an axis of rotation transverse to the direction of flow and being disposed within the chamber for rotation therein. The rotor comprises blades, each blade having a proximal and distal end and the blades diverging from the proximal end and extending in spaced relation from the axis of rotation along an axial length thereof. The method comprises feeding the suspension from the suspension transfer line through the inlet into the chamber, introducing chemicals into the fiber suspension upstream of the fluidizing rotor, rotating the fluidizing rotor within the chamber so as to form an open center bounded by a surface of revolution and subjecting the suspension moving toward the outlet to a shear force field sufficient to fluidize the suspension, to mix the chemicals evenly into the suspension and to render the suspension flowable, flowing the suspension through the open center of the rotor, and discharging the suspension from the chamber through the suspension outlet.

The above-described mixer has found a number of imitations, of which, for example, U.S. Pat. No. 5,575,559 and U.S. Pat. No. 5,918,978 can be mentioned.

All the above-discussed mixers have a few features in common. The rotor is brought into the mixing chamber in a direction perpendicular to the axis of the flow through the mixing chamber. The rotor is formed of finger-like blades, which leave the center of the rotor open. The rotor shaft and the rotor blades are arranged such that the mixing chamber with the rotor installed does not form a symmetrical mixing space, but an asymmetrical one, where the turbulence created by the rotor is not optimal. The result is that the mixing of the chemical with the fiber suspension is not even, but in some areas of the mixer the turbulence level is higher, resulting in more even mixing than in areas where the turbulence level is lower.

There is yet another mixer where the transverse rotor construction has been used. The mixer has been discussed in EP-B2-0 606 250. Here the mixer for admixing a treatment agent to a pulp suspension having a consistency of 10-25% comprises a cylindrical housing with a mixing chamber defined between an inner wall of the cylindrical housing and a casing of a coaxially mounted, substantially cylindrical rotor provided with mixing members on its casing surface, an inlet in the housing for supplying pulp to the mixing chamber, an inlet in the housing for supplying treatment agent to the mixing chamber and an outlet for withdrawing mixed pulp and treatment agent, a mixing zone in the housing provided with stationary mixing members wherein a gap is defined between the mixing members of the rotor and the stationary mixing members. The mixing chamber and the mixing zone have a width corresponding to the axial length of the rotor. The stationary mixing members are arranged on a portion within an angle of 15-180 degrees of the inner wall of the housing. The pulp inlet and the treatment agent inlet extend along the entire width of the mixing chamber for adding the pulp and the treatment agent each in well-formed thin layers. The inlet for the treatment agent is connected to the mixing chamber at a circumferential position prior to the mixing zone. The outlet extends along the entire width of the mixing chamber, and a cylindrical surface is formed directly after the outlet to prevent pulp from flowing backward past the rotor. In other words, the mixer of the EP patent has a closed cylindrical rotor with solid mixing members on the rotor surface. The cylindrical rotor is positioned in a cylindrical mixing chamber. The basic idea in the EP document is to feed both pulp and the chemical as thin layers in the mixing zone between the rotor and the chamber wall and mix such there.

However, based on practical experiences it has been learned that the mixing is not very efficient in the narrow slot between the rotor and the mixing chamber. Also, it has been learned that the energy consumption of this type of mixer is high compared, for instance, to the mixer discussed in U.S. Pat. No. 5,279,709 mentioned first.

SUMMARY OF THE INVENTION

At least some of the problems of the prior art mixers, and homogenizers, by which are understood devices which subject a medium to such a turbulence that the homogeneity of the medium is improved irrespective of whether another medium is to be mixed with the first medium or whether only the homogeneity of the first medium is to be improved, are solved by means of the present invention, an essential feature of which is the circulation of the medium in both the radial and the axial directions in the mixing chamber. Preferably the circulation of the medium should be symmetrical in relation to the centerline of the mixing chamber.

Another preferred but not necessarily an essential feature of the present invention is the symmetry of the mixing chamber and/or the rotor in relation to the centerline of the mixing chamber.

Yet another preferred feature of the invention is that the center of the mixer rotor is at least partially closed so that both a direct flow through the rotor and collection of gas at the center of the rotor are prevented.

The method, the apparatus and the rotor of the present invention will be described in more detail in the following with reference to various embodiments of the present invention and to the accompanying drawings.

BRIEF DESCRIPTION OF THE DRAWINGS

FIG. 4 illustrates a schematical cross-section of a preferred embodiment of the present invention along line A-A of FIG. 2*a*, and FIG. 5 illustrates a schematical cross-section of another preferred embodiment of the present invention in the manner shown in FIG. 4.

DESCRIPTION OF THE PREFERRED EMBODIMENTS

Figure 1:
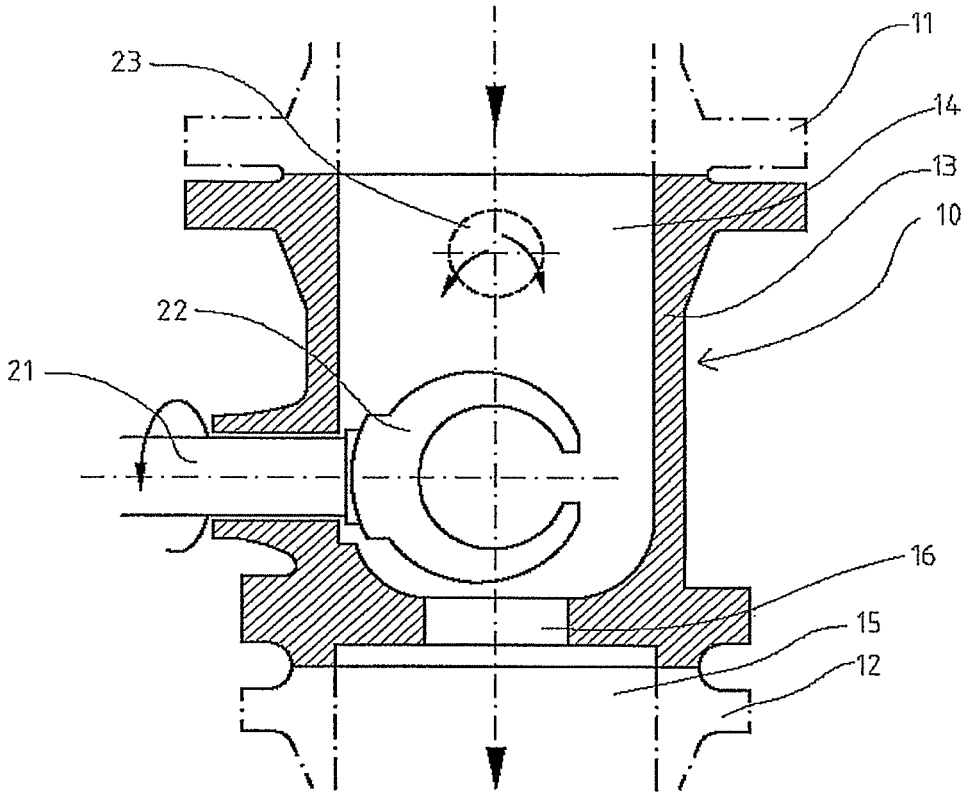
Fig. 1 Prior art
FIG. 1 illustrates a cross-section of a prior art mixer discussed in detail in U.S. Pat. No. 5,279,709.

FIG. 1 discloses a prior art mixer discussed in detail in U.S. Pat. No. 5,279,709. The mixer 10 comprises in general a substantially cylindrical or sometimes almost ball-shaped chamber 13 provided with an inlet 14 connected to an inlet pipe 11 and an outlet 15 connected to an outlet pipe 12. The inlet 14 of the chamber 13 is provided with an inlet opening 23 (shown by a dotted circle) for chemicals through which opening, for instance, bleaching chemicals may be beforehand added into the pulp flow prior to mixing. The opening for the chemicals may, however, be located almost anywhere upstream of the mixer chamber. The outlet 15 is provided with a throttling 16, i.e. an area having a reduced diameter with respect to both the chamber 13 and the outlet pipe 12. A substantially radial shaft 21 protrudes through the wall of the chamber 13 and a fluidizing element 22 is attached to the other end of the shaft 21 inside the chamber 13. Although the position of the shaft 21 shown in FIG. 1 is substantially radial or perpendicular to the direction of flow or to the axis of the chamber 13, shaft 21 may also deviate from that perpendicular position by up to about 30 degrees. The fluidizing element is a rotor having a plurality of substantially axially located blades. The blades are preferably formed of an elongated steel plate having a rectangular cross-section and having radially an inner and an outer edge. The blades may, however, be of any appropriate form as long as the center of the rotor is open. The blades are arranged with the inner edges located at a distance from the axis of the rotor in such a way that the center of the rotor remains open, thus allowing the fiber suspension to flow through the center of the rotor, whereby the rotor itself causes as little resistance to the flow as possible. The blades may be either straight axial or somewhat arcuate thus forming a cylinder-, ball- or barrel-shaped envelope surface during rotation thereof. Preferably, the rotor is provided with more than two blades so that always, even when the rotation of the rotor is for some reason stopped, at least one of the blades is creating turbulence in the suspension. In other words, the creation of an otherwise entirely open space between the rotating blades and through the rotor is being prevented. Nevertheless, the rotor, at the same time, permits the suspension flow to pass the blades and thus to go through the rotor.

The operation of the apparatus is such that the fiber suspension flow, for instance, from a fluidizing centrifugal pump, is introduced to chamber 13 through inlet 14 and simultaneously chemicals are fed through opening 23, either located in connection with the mixer chamber or somewhere upstream thereof, to the fiber suspension. The fluidizing element, i.e. the rotor, while rapidly rotating, causes the fiber suspension to break into small fiber flocs whereby the chemicals are mixed with the suspension.

Figure 2A:
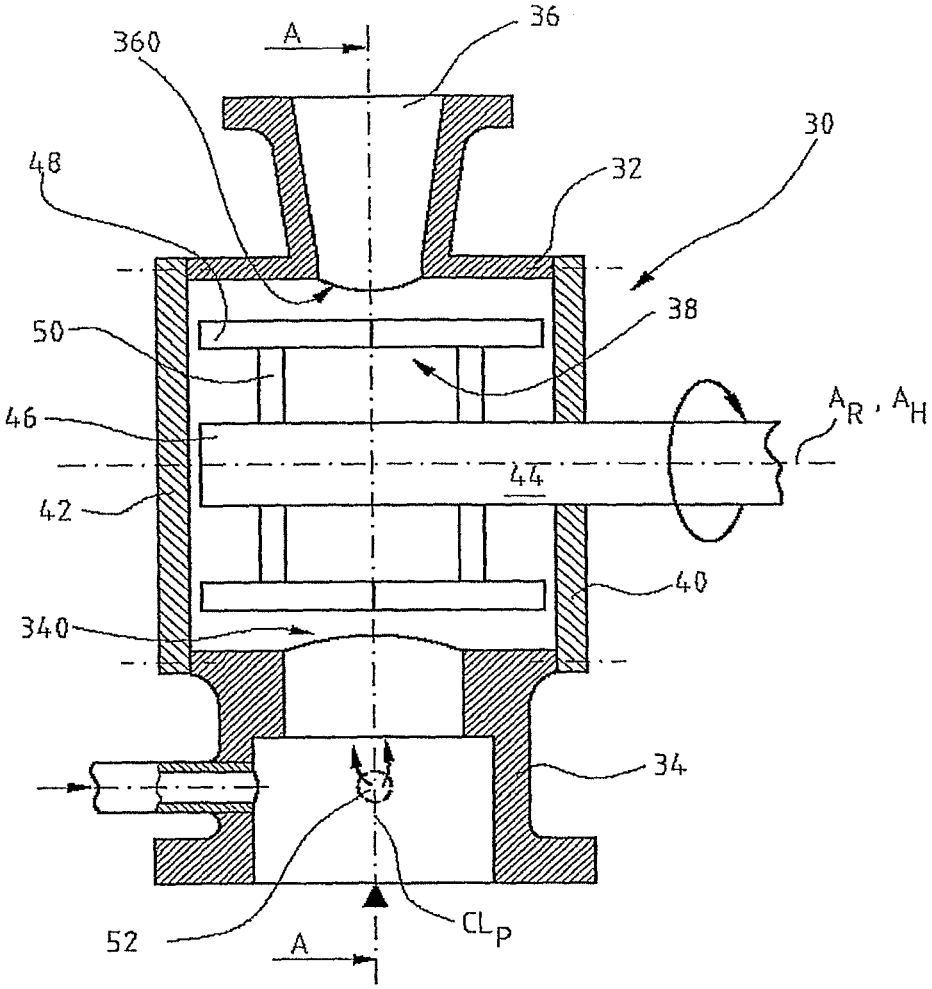
FIG. 2*a* illustrates a schematical axial cross-section of a first preferred embodiment of the present invention.

FIG. 2*a* shows a schematical cross-section of a preferred embodiment of the present invention. The homogenizer 30, which from now on is called, for the sake of simplicity, a mixer, comprises a housing 32, the interior thereof being called a homogenizing chamber or mixing chamber, with an inlet duct 34 having an inlet opening 340 into the homogenizing or mixing chamber and an outlet duct 36 having an outlet opening 360 from the homogenizing or mixing chamber and a rotor 38 arranged transverse to the direction of flow from the inlet opening 340 to the outlet opening 360. The housing 32 is, in this embodiment of the invention, preferably of a substantially cylindrical shape so that the axis $A_R$ of the rotor 38 runs at least substantially parallel to the axis $A_H$ of the housing 32. Yet the axis $A_R$ of the rotor may coincide, as shown in FIG. 2*a*, with the axis $A_H$ of the housing, i.e. the homogenizing chamber, or the rotor could be eccentrically positioned in relation to the housing. The housing is further provided with two end caps 40 and 42. The end cap 40 includes a substantially central opening for the shaft 44 of the rotor 38 with the necessary sealing, and possibly also with bearings for the shaft 44. The opposite end of the housing 32 is provided with another end cap 42, which is, in accordance with a preferred embodiment of the invention, a solid substantially round plate. However, the end cap 42 may be whichever shape is required to perform its task of closing the other end of the housing 32. For maintenance and repair reasons at least the end cap 40 including the opening for the shaft 44 is removable, i.e. fastened by means of, for instance, bolts or screws to the housing 32. To fulfill the requirements of the symmetry, the surfaces of the end caps 40, 42 facing each other are preferably alike. They may either be smooth plates, or they may be provided with turbulence elements like grooves or ridges or pins or blades as long as the elements appear substantially similar on both opposing surfaces.

The substantially cylindrical wall of the housing 32 is provided with the inlet opening 340, and the outlet opening 360, as explained above. Both the inlet and the outlet openings are, preferably, of such a shape that they both have a center and an axis of symmetry, which lie substantially in the same plane. This plane of symmetry, so-called centerline plane $CL_P$, runs along the centerline of the housing perpendicular to the axis $A_H$ of the housing. The centerline plane of the openings coincides with a centerline plane of the housing, which runs at an equal distance from the end caps 40, and 42. However, it has to be understood that if, for instance, for manufacturing or other corresponding reasons, the line running via the centers of the inlet and the outlet openings does not exactly coincide with the centerline of the housing but is still very close thereto, or is not exactly perpendicular to the housing axis $A_H$, but the operation of the rotor and the openings results in substantially symmetrical turbulence fields within the housing, the location of the openings should be considered as fulfilling the requirements of this invention.

The rotor 38 has a shaft 44 running through the mixer housing 32 so that the end 46 of the shaft 44 is positioned at a short distance from the end cap 42. The distance from the inner surface of the end cap to the end surface of the shaft is of the order of a few millimeters, preferably 1-5 millimeters. According to a preferred embodiment of the invention the shaft 44 extends from one end of the housing 32 to the second end of the housing. In broader terms, the gap between the shaft end surface and the end cap 42 is such that it does not change the flow behavior of the pulp within the mixing chamber to a significant degree. Thereby the allowable size of the gap depends, for instance, on the consistency of the pulp to be treated.

According to another optional embodiment of the invention the end cap at the second end of the housing is provided with a member protruding axially towards the shaft such that a similar gap is left between the shaft end and the member as discussed above. The diameter and overall shape of the member correspond to that of the rotor shaft to fulfill the requirements of symmetry. The member could also be tubular such that an end part of the shaft extends inside the member whereby the shaft end part should, preferably, be provided with a smaller diameter so that the outer diameter of the tubular member corresponds to the full diameter of the shaft.

As a further optional embodiment the member may extend from the second end cap at a close proximity to the first end cap whereby the rotor shaft terminates near the first end cap, whereby the rotor blades are attached to their shaft only at their first end. In this optional structure it has to be ensured that the symmetry is maintained by designing the opposite end of the rotor-housing combination such that it corresponds to the first end thereof.

As a yet further option a structure can be mentioned where an opening for the shaft 44 has been arranged in the other end cap 42, too. The opening should, at least, be provided with the necessary sealing, and possibly the end cap 42 with bearings for supporting the shaft end.

Another feature of the invention is that the diameter of the shaft 44 is of significant magnitude compared to the diameter of the housing 32. The purpose of the size, shape and location of the shaft 44 is to ensure that the center of the housing is closed whereby gas cannot collect there. This is accomplished by arranging no or very little volume of lower pressure inside the housing, in the so-called mixing or homogenization chamber where the gas could collect.

The rotor 38 further has a number of blades 48 positioned at a distance from both the rotor shaft 44, and the inner surface of the housing 32. The blades 48 are fastened to the shaft 44 by means of distance members or arms 50. Basically, the shape of the arms has been discussed in connection with FIGS. 10 through 13 of U.S. Pat. No. 5,791,778, the entire contents of which are hereby incorporated as a reference herein. The arms are positioned at a substantially equal distance from the centerline plane of the rotor, the centerline of the rotor lying on the centerline plane $CL_P$ of the housing. The centerline plane of the rotor could as well be called as a plane of symmetry of the rotor. Thus the part of the rotor within the chamber also fulfils the requirements of symmetry.

Figure 2B:
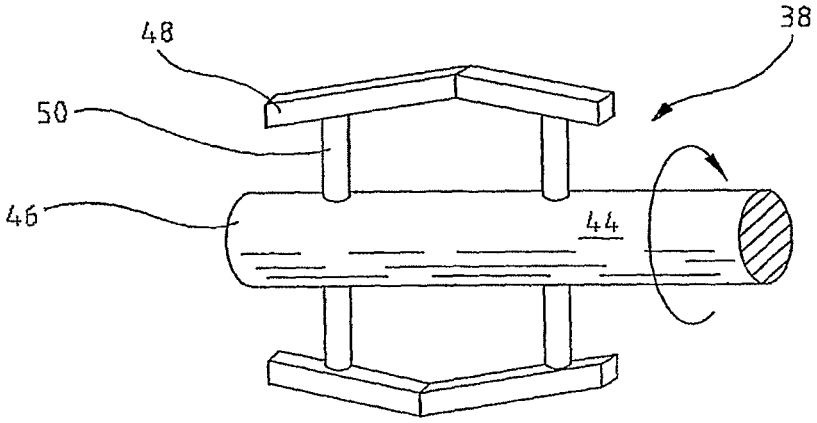
FIG. 2*b* illustrates an oblique view of a rotor according to the first preferred embodiment shown in FIG. 2*a*.

The blades 48 as well as the arms 50 have several tasks. Firstly, since it is a question of a mixing or a homogenizing apparatus, it is clear that the main purpose of the apparatus is to act as an efficient turbulence generator. This has been ensured by the following measures:

- the inside of the housing is substantially symmetrical whereby the mixing or turbulence generation conditions at both ends of the housing are the same,
- the blades 48 have been arranged in an optimal location between the shaft 44, and the inner wall of the housing 32, the exact location depending on, for instance, the medium to be treated, the consistency of the medium, the gas content of the medium, and/or the amount of gas added to the medium, the volume flow through the housing, etc.,
- the circulation of the medium in the housing
  - firstly, the blades 48 subject the medium to centrifugal forces pushing the medium towards the inner wall of the housing 32. This creates a recirculation round the blades 48 as the more medium the blades 48 move to the inner wall the more medium has to move axially inwardly to clear space for the outwardly moving medium,
  - secondly, the blades 48 subject the medium to axial forces pushing the medium axially to the sides of the housing 32. This has been accomplished by arranging the blades 48 to a straight inclined—such as the blades shown in FIG. 2*b*—or spiral position in relation to the axial direction. The blades 48 may extend from the proximity of the first end cap 40 to the proximity of the second end cap 42, whereby the blades need to be bent at the centerline plane of the housing. Another alternative is to arrange separate blades on each side of the rotor. However, in such a case the blades are positioned symmetrically on both sides of the centerline plane so that the angular direction of the blades is substantially the same in relation to the centerline plane, the blades are attached to the shaft by means of arms arranged at an equal distance to the centerline plane, and both start and terminate at an equal distance to the centerline plane, and the end caps. Yet one more, in itself a natural prerequisite of the rotor of the invention, is that the number of these separate blades on both axial sides of the rotor, or the centerline plane, is the same, and that the blades are located at regular intervals on the circumference of the rotor shaft. However, when considering the symmetry requirements of the present invention, especially in view of a functioning rotor, the separate blades on each side of the centerline plane of the rotor need not be arranged as if a bent unitary blade 48 or 148 of FIGS. 2*a*, 2*b* and 3 were just cut in two parts along the centerline plane, but there may be a circumferential step between the blades on the opposite side of the centerline plane. The axial pumping effect of the blades 48 while forcing medium to the ends of the housing 32, or mixing chamber, simultaneously creates a circulating flow as the medium already present at the ends of the housing has to move towards the centerline plane to free space for the medium pumped by the blades 48. A preferred range for the inclination angle of the blades in relation to the centerline plane is from 20 to 60 degrees. The pumping effect of the blade is ensured by arranging the inclination such that the part of the blade closest to the centerline plane is the leading part of the blade.
- due to the function of the rotor blades there is both radial and axial recirculation in the mixing chamber. The symmetrical shape of the mixing chamber and the rotor ensure that the turbulence field within the chamber is symmetrical, too.

Secondly, since the device is a rotating member, the purpose of which is to homogenize or to mix a medium or media, the rotating members should not separate gas from the medium. This has been taken into account by filling the rotor center with the shaft 44 and, preferably, designing the cross-section of the rotor blades 48 and arms 50 in as optimal a manner as possible. However, also the economical factors have to be taken into account whereby the most complicated cross-sectional shapes may be out of the question due to their expensive manufacturing methods.

FIG. 2*a* shows yet one more feature, which is not needed if the device is a homogenizer, but which may be needed if it is a mixer, namely the chemical inlet or inlet opening 52. In the embodiment shown in FIG. 2*a*, the chemical inlet opening 52 is located in the inlet duct 34 upstream of the mixer chamber. The chemical inlet may, depending mainly on the chemical, be formed of one opening, of several openings, of a perforated pipe section, or of a porous pipe section just to name a few alternatives. Again depending at least partially on the chemical, the chemical inlet may be positioned in the inlet duct, as shown in FIG. 2*a*, or upstream thereof. Sometimes the chemical could also be introduced directly into the mixing chamber via end caps (symmetrically), via the rotor shaft, via the rotor shaft and blades, or via an opening in the housing wall either to the centerline plane of the housing or via two or more openings arranged symmetrically to the housing centerline plane.

Figure 3:
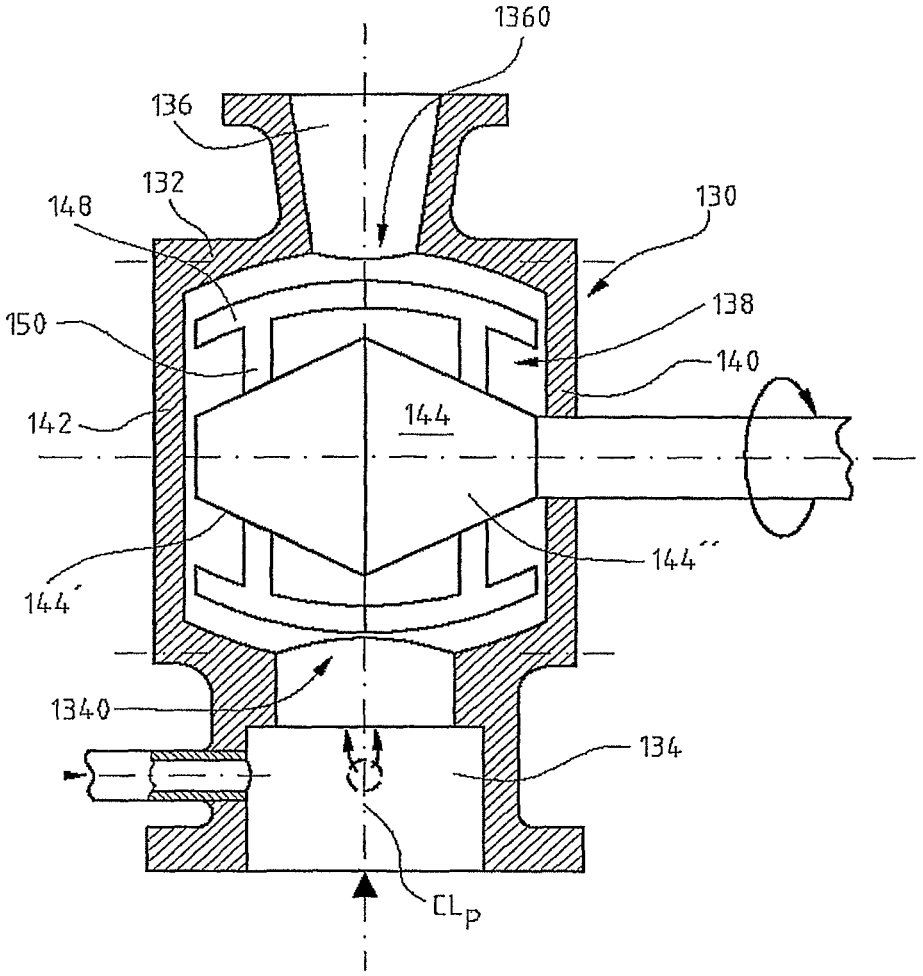
FIG. 3 illustrates a schematical axial cross-section of a second preferred embodiment of the present invention.

FIG. 3 illustrates schematically another preferred embodiment of the present invention. In this embodiment the mixer 130 has a substantially rotationally symmetric, for instance a barrel-shaped, housing 132 with an inlet duct 134, an outlet duct 136, corresponding inlet and outlet openings 1340, and 1360, respectively, and end caps 140, 142 similar to the ones discussed in connection with FIG. 2*a*. In this embodiment the largest diameter, or largest cross-section of the mixing chamber, is at the centerline plane, i.e. at the plane of symmetry of the housing, from where the cross-section decreases towards the ends of the housing in a similar manner at both sides of the centerline plane.

The rotor 138 of this embodiment has several features differing from the ones shown in the embodiment of FIG. 2*a*. Here the rotor shaft 144 within the mixing chamber is formed of two frusto-conical parts 144' and 144" so that the bases of the cones lie against each other on the plane perpendicular to the axis $A_R$ of the rotor shaft 144, the so-called centerline plane $CL_P$, or the plane of symmetry of the rotor, the plane also running substantially via the centers of the inlet opening 1340 and the outlet opening 1360. Thus the diameter of the shaft 144 is reduced towards the end caps 140, and 142. The diameter of the rotor shaft 144 may change in whichever manner as long as it does so substantially symmetrically to the above-mentioned centerline plane. Thus the rotor shaft 144 may be, for instance, barrel-shaped, hourglass-shaped or whatever desired shape. At this stage it is worth mentioning that the non-cylindrical shaft shape may be applied to any housing shape and vice versa. The only prerequisite for both the housing and the rotor is that they are substantially symmetrical with respect to the above-defined centerline plane.

The rotor 138 of this embodiment has blades 148 the outer contour of which corresponds, in accordance with a further preferred embodiment of the invention, to the shape of the inner wall of the housing 132. The blades 148 are fastened to the shaft 144 by means of arms 150, which are positioned, preferably, at a certain distance from both the end caps 140, 142, and the centerline plane CLp. The same basic principles as discussed in connection with FIG. 2*a* apply to the blades of this embodiment, too. In a similar manner the discussion concerning the possible introduction of the chemical applies here, too.

The cross-sectional shape of the homogenizing chamber has not been discussed in more detail. It has only been mentioned that it is either cylindrical or rotationally symmetric. However, the homogenizing chamber may, in fact, be of any shape as long as it is substantially symmetric in relation to the centerline plane of the housing or, rather, of the homogenizing chamber, defined earlier. Thus the cross-section thereof may be elliptical or polygonal, just to name a couple of different forms. As to the positioning of the rotor within the homogenizing chamber, there are only two prerequisites. The first prerequisite is that the rotor axis is at least substantially parallel to the housing axis (corresponding to the axis of the homogenizing chamber), either coinciding therewith or being eccentric. The second prerequisite is that the centerline plane of the homogenizing chamber and the centerline plane of the rotor coincide. In fact the disclosure herein talks mainly about a centerline plane irrespective of the plane in question.

Further, the closer structure of the chamber walls has not been discussed yet. The walls may be provided with turbulence elements like pins or bars or stationary blades or ribs, which work more or less together with the blades of the rotor. The size, shape and direction of the elements may change along the length of the chamber, however, keeping in mind that the result of the cooperation of the rotor and the elements on the chamber wall should be a turbulence field, which is symmetrical in relation to the centerline of the housing. Thus the bars or blades on the wall could, for instance, be designed or directed to aid in feeding the medium towards the end caps from the centerline plane.

In a similar manner, the end caps could be provided with turbulence elements like ribs, blades or pins to increase the turbulence in the chamber.

In fact, what is meant by the term "symmetric" in connection with both the rotor and the mixing chamber or the homogenizing chamber is that the shape of the rotor together with the mixing or the homogenizing chamber should be such that the turbulence field created in the chamber is as symmetrical in relation to the centerline plane of the housing as possible. Thus it is possible that the shapes of both the chamber and the rotor deviate somewhat from exactly symmetrical shapes due to, for instance, structures needed for supporting and/or sealing the shaft of the rotor within the first end cap. Also some other slight modifications in either the rotor or the chamber structure, or in both, are possible, as long as the goal, and preferably the result, is a symmetric turbulence field.

FIG. 4 shows a cross-section of an apparatus in accordance with a preferred embodiment of the present invention along line A-A of FIG. 2*a*. FIG. 4 shows the housing 32 with an inlet duct 34 and an outlet duct 36. The inlet duct 34 has been designed such that the inlet duct opens in substantially tangential direction into the housing 32 against the direction of rotation of the rotor. The purpose of this construction is to maximize the turbulence as the speed of the medium introduced into the housing, together with the rotational velocity of the rotor acting in the opposite direction, creates a maximal velocity difference, which results in maximum turbulence.

The outlet duct 36 departs the housing 32 in a, preferably, tangential direction, but contrary to the inlet duct, in the direction of rotation of the rotor. The purpose of this construction is two-fold: firstly, by streamlining the outlet duct, keeping in mind the hydrodynamic principles, the separation of gas from the medium is prevented, and secondly, the streamlined outlet duct minimizes the pressure losses in the outlet duct, as there is no need to create extra turbulence.

FIG. 5 shows a cross-section of an apparatus in accordance with another preferred embodiment of the present invention. In this embodiment the only difference to the apparatus of FIG. 4 is the location of the outlet duct 36' in relation to the inlet duct 34'. Now the outlet duct has been positioned about 270 degrees from the inlet duct in the direction of rotation of the rotor whereas the position in FIG. 4 was about 180 degrees. Thus the positions of the inlet duct and the outlet duct can be freely chosen, but keeping in mind that the outlet duct should be at least 180 degrees from the inlet duct in the direction of rotation of the rotor, so that the material or medium to be homogenized cannot so easily escape from the inlet duct directly to the outlet duct.

It should, however, be understood that though FIGS. 4 and 5 give an impression that the inlet duct and the outlet duct run along the centerline plane of the housing, it is just a preferred option. The inlet duct and/or the outlet duct may extend in any feasible direction from the homogenizing chamber as long as the inlet opening and the outlet opening are arranged substantially symmetrically to the centerline plane, i.e. the plane running via the centers of the openings. Thus FIGS. 4 and 5 could as well be understood such that the apparatus in the figures has been cut along the centerlines of the ducts whereby the duct/ducts may be curved, too.

Finally, it should be understood that, in the above, only a few preferred embodiments of the invention have been discussed without any intention to limit the scope of the invention to those embodiments only. Thus the scope of the invention is defined only by the appended claims.

The invention claimed is:

1. A method of homogenizing a medium in an apparatus, the apparatus including
- a housing having
  - a homogenizing chamber with a circumferential wall, and
  - two end caps at the opposite ends of the chamber,
    - the circumferential wall having an inlet opening and an outlet opening,
      - the inlet opening communicating with an inlet duct, and
      - the outlet opening communicating with an outlet duct,
      - both openings having a center;
  - a center line plane between the end caps;
    - the center line plane running essentially via the centers of the inlet opening and the outlet opening; and
- a rotor having
  - blades and
  - an axis extending through the homogenizing chamber;
  - the center line plane running at essentially right angles to the rotor axis,
  - the rotor blades being arranged symmetrically on both sides of the center line plane, each rotor blade being inclined in relation to a plane defined by the rotor axis and an intersecting point between the respective rotor blade and the center line plane, in which method the medium to be homogenized
- is introduced into the homogenizing chamber transverse to the rotor axis through the inlet duct and the inlet opening,
- is homogenized in the chamber and
- is discharged therefrom via the outlet opening and the outlet duct, the method comprising the step of
- forcing the medium within the homogenizing chamber
  - to radially circulating movement, and
  - to axially circulating symmetrical movement on both axial sides of the center line plane by pumping the medium by means of the rotor blades towards the end caps of the housing, i.e. to the axial sides of the blades.

2. The method as recited in claim 1, wherein the medium is introduced along the center line plane into the homogenizing chamber.

3. The method as recited in claim 1, wherein the medium is discharged along the center line plane from the homogenizing chamber.

4. The method as recited in any claim 1, further comprising the step of providing one of the homogenizing chamber, the inlet duct and upstream of the inlet duct with at least one inlet opening for a chemical.

5. The method as recited in claim 1, further comprising the step of providing chemical in the homogenizing chamber via the rotor.

6. A method of homogenizing a medium in an apparatus, the apparatus including
- a housing having
  - a homogenizing chamber with a circumferential wall, and
  - two end caps at the opposite ends of the chamber,
    - the circumferential wall having an inlet opening and an outlet opening,
      - the inlet opening communicating with an inlet duct and
      - the outlet opening communicating with an outlet duct,
      - both openings having a center;
  - a center line plane between the end caps;
    - the center line plane running essentially via the centers of the inlet opening and the outlet opening; and
- a rotor having
  - blades and
  - an axis extending through the homogenizing chamber;
  - the center line plane running at essentially right angles to the rotor axis,
  - the rotor blades being arranged symmetrically on both sides of the center line plane, each rotor blade being inclined in relation to a plane defined by the rotor axis and an intersecting point between the respective rotor blade and the center line plane, in which method the medium to be homogenized
- is introduced into the homogenizing chamber transverse to the rotor axis through the inlet duct and the inlet opening,
- is homogenized in the chamber and
- is discharged therefrom via the outlet opening and the outlet duct, the method comprising the steps of
- providing the rotor blade with a part closest to the center line plane, the part of the blade being, when rotating the rotor, the leading part of the blade, and
- forcing the medium within the homogenizing chamber
  - to recirculation round the blades, and
  - to axially circulating symmetrical movement on both axial sides of the center line plane by the rotor blades.

7. The method as recited in claim 6, wherein the medium is introduced along the center line plane into the homogenizing chamber.

8. The method as recited in claim 6, wherein the medium is discharged along the center line plane from the homogenizing chamber.

9. The method as recited in claim 6, wherein the medium is pumped by means of the blades towards the end caps of the housing, i.e. to the axial sides of the blades.

10. The method as recited in any claim 6, further comprising the step of providing one of the homogenizing chamber, the inlet duct and upstream of the inlet duct with at least one inlet opening for a chemical.

11. The method as recited in claim 6, further comprising the step of providing chemical in the homogenizing chamber via the rotor.

12. The method of claim 1, wherein the rotor is provided with separate blades arranged symmetrically on both sides of the center line plane.

13. The method of claim 6, wherein the rotor is provided with separate blades arranged symmetrically on both sides of the center line plane.

* * * * *